US007108609B2

(12) United States Patent
Stites et al.

(10) Patent No.: US 7,108,609 B2
(45) Date of Patent: Sep. 19, 2006

(54) GOLF CLUB HAVING A WEIGHT POSITIONING SYSTEM

(75) Inventors: John Thomas Stites, Weatherford, TX (US); Gary Gene Tavares, Fort Worth, TX (US)

(73) Assignee: NIKE, Inc., Beaverton, OR (US)

( * ) Notice: Subject to any disclaimer, the term of this patent is extended or adjusted under 35 U.S.C. 154(b) by 67 days.

(21) Appl. No.: 10/615,934

(22) Filed: Jul. 10, 2003

(65) Prior Publication Data

US 2005/0009625 A1 Jan. 13, 2005

(51) Int. Cl.
*A63B 53/04* (2006.01)
*A63B 53/06* (2006.01)
*A63B 69/36* (2006.01)

(52) U.S. Cl. ..... 473/256; 473/334; 473/335; 473/338; 473/339

(58) Field of Classification Search ..... 473/334, 473/335, 338, 339, 256, 336, 337, 345, 349, 473/350; D21/733, 734
See application file for complete search history.

(56) References Cited

U.S. PATENT DOCUMENTS

| | | | | | |
|---|---|---|---|---|---|
| 1,518,316 | A | | 12/1924 | Ellingham | |
| 1,562,956 | A | | 3/1925 | Guerne | |
| 2,098,445 | A | * | 11/1937 | Wettlaufer | 473/333 |
| 2,171,383 | A | * | 8/1939 | Wettlaufer | 473/335 |
| 2,163,091 | A | | 12/1939 | Held | |
| 2,460,445 | A | | 4/1949 | Bigler | |
| 3,199,874 | A | * | 8/1965 | Blasing | 473/244 |
| 3,610,630 | A | | 10/1971 | Glover | |
| 3,743,297 | A | | 7/1973 | Dennis | |
| 3,759,527 | A | | 9/1973 | Witherspoon | |
| 4,052,075 | A | | 10/1977 | Daly | |
| 4,195,842 | A | | 4/1980 | Coleman | |
| 4,895,371 | A | | 1/1990 | Bushner | |
| 5,121,922 | A | | 6/1992 | Harsh, Sr. | |
| 5,253,869 | A | * | 10/1993 | Dingle et al. | 473/245 |
| 5,385,348 | A | | 1/1995 | Wargo | |
| 5,421,577 | A | * | 6/1995 | Kobayashi | 473/335 |
| 5,429,356 | A | * | 7/1995 | Dingle et al. | 473/251 |
| 5,571,053 | A | | 11/1996 | Lane | |
| 5,683,309 | A | | 11/1997 | Reimers | |
| 5,688,189 | A | | 11/1997 | Bland | |
| 5,916,042 | A | | 6/1999 | Reimers | |
| 6,015,354 | A | | 1/2000 | Ahn et al. | |
| 6,077,173 | A | | 6/2000 | Stites | |
| 6,089,994 | A | | 7/2000 | Sun | |
| 6,149,533 | A | | 11/2000 | Finn | |

(Continued)

FOREIGN PATENT DOCUMENTS

DE 37 11 964 12/1988

(Continued)

OTHER PUBLICATIONS

International Search Report In corresponding PCT application, Application No. PCT/US2004/017421, mailed Nov. 29, 2004.

(Continued)

*Primary Examiner*—Sebastiano Passaniti
(74) *Attorney, Agent, or Firm*—Banner & Witcoff, Ltd.

(57) ABSTRACT

A golf club head is disclosed that includes weight positioning system for modifying a position of a center of gravity of the golf club head. The weight positioning system includes a weight and a support. The weight is independently movable along the support to change the position of the center of gravity in a first direction, and the weight is independently movable around the support to change the position of the center of gravity in a second direction.

50 Claims, 10 Drawing Sheets

U.S. PATENT DOCUMENTS 6,277,032 B1 8/2001 Smith
6,514,154 B1 * 2/2003 Finn ..... 473/306

FOREIGN PATENT DOCUMENTS

GB 194823 3/1923
GB 2327889 2/1999

OTHER PUBLICATIONS

International Search Report In corresponding PCT application, application No. PCT/US2004/017421, mailed Nov. 29, 2004 (7 pages).

* cited by examiner

GOLF CLUB HAVING A WEIGHT POSITIONING SYSTEM

BACKGROUND OF THE INVENTION

1. Field of the Invention

The present invention relates to the game of golf. The invention concerns, more particularly, a weight positioning system for modifying a position of a center of gravity of a golf club head.

2. Description of Background Art

The formal origins of the game of golf, one of the oldest international sports, dates to the $16^{th}$ century at The Royal and Ancient Golf Club at St. Andrews, located in Scotland. During successive centuries, the game of golf has gained and maintained a populous following due to inherent challenges of the game, a prestigious reputation, and its suitability for relaxation.

Growth in the number of individuals playing the game of golf provides an incentive for manufacturers of golf equipment, which includes golf clubs, balls, footwear, and bags, to improve upon the various features and characteristics of the golf equipment. Golf equipment has, therefore, evolved over time to provide enhanced performance and suitability for a wide range of playing abilities and styles. Many traditional golf balls, for example, included a wound, twine core and a balata rubber cover. More modern golf balls, however, may incorporate a solid core formed of polybutadiene, titanium, nickel, or cobalt, and a cover formed of ionomeric resin, surlyn, or polyurethane. Similarly, footwear intended for the game of golf traditionally utilized sharp, metallic spikes that provided a high degree of traction at the expense of damaging floors and other walking surfaces. In response, modern footwear incorporates polymer structures that provide a comparable degree of traction without damaging walking surfaces. Advances in golf club technology are also of particular interest to sporting goods manufacturers. Golf club shafts, for example, were often fashioned from wood, and are commonly formed of metal or graphite materials today. Whereas golf club heads of drivers were also fashioned from wood, modern drivers generally utilize heads formed of metals, such as steel, aluminum, or titanium.

A golf club head generally includes a substantially planar contact area for engaging a golf ball and propelling the golf ball in an intended direction. One factor that determines whether the golf ball is propelled in the intended direction relates to a position of a center of gravity of the golf club head. When the center of gravity is positioned behind the point of engagement on the contact surface, the golf ball follows a generally straight route. When the center of gravity is spaced to a side of the point of engagement, however, the golf ball may follow a route that curves left or right, which is often referred to as a hook or a slice. Similarly, when the center of gravity is spaced above or below the point of engagement, the route of the golf ball may exhibit a boring or climbing trajectory.

Most conventional golf club heads have a fixed center of gravity intended to accommodate a majority of the individuals that play the game of golf. Although golf club heads with a fixed center of gravity are popular among individuals that play the game of golf, systems permitting an individual to adjust or reposition the center of gravity have been proposed. A first type of positioning system involves a translating weight. U.S. Pat. No. 6,277,032 to Smith, for example, discloses a rotatable screw extending through a void in the golf club head. Rotation of the screw induces a weight to move along the length of the screw, thereby altering the position of the center of gravity. A second type of positioning system is disclosed in U.S. Pat. No. 5,916,042 to Reimers and generally involves a rotatable, eccentric weight that rotates around a central axis to alter the position of the center of gravity. A third type of positioning system, as disclosed in U.S. Pat. No. 5,385,348 to Wargo, includes a removable element of the golf club head that may be replaced by an alternate element having a different weight or moved to a different position of the golf club head, thereby altering the position of the center of gravity.

SUMMARY OF THE INVENTION

The present invention is a golf club head that includes a face and a weight positioning system. The face provides a contact area for engaging a golf ball, and the weight positioning system includes a support and a weight. The weight is movable along the support and around the support to vary a position of a center of gravity of the golf club head with respect to the face.

The weight, in another aspect of the invention, may be independently movable along the support, and the weight may be independently movable around the support. That is, the weight may be moved along the support without affecting the angular position of the weight with respect to the support. Similarly, the weight may be moved around the support without affecting the longitudinal position of the weight with respect to the support. This configuration permits the center of gravity to be repositioned in only the first direction, only the second direction, or in a combination of the first and second directions. The weight may have many configurations within the scope of the present invention, including a generally rounded shape, a rectangular shape, a triangular shape, or a shape that includes a pair of arms with masses suspended on ends of the arms.

In addition to the weight and the support, the weight positioning system may also include a locking mechanism and a connector. The locking mechanism is utilized to secure a position of the weight relative to the support. A pair of locking rings, for example, positioned on opposite sides of the weight may be utilized as the locking mechanism. The connector is utilized to secure the weight positioning system to the golf club head.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose various golf clubs in accordance with the present invention, which may be a driver, a putter, or an iron, for example. Each golf club includes a head with a weight positioning system for varying a position of a center of gravity of the head. The weight positioning system has a support, and the weight positioning system has a weight that is movable along the support and around the support. Accordingly, the weight may be moved in three dimensions to vary the position of the center of gravity with respect to a face of the golf club.

A golf club 10 in accordance with the present invention is disclosed in FIGS. 1–8. The primary elements of golf club 10, which has the general configuration of a driver, are a shaft 11 and a head 12. Shaft 11 has a generally elongate configuration and may be formed of conventional materials, including graphite or steel. A grip may extend over a first end of shaft 11 to provide a comfortable and slip-resistant area for grasping golf club 10. Head 12 is secured to a second end of shaft 11 and is configured to engage a golf ball, thereby propelling the golf ball in an intended direction. As depicted in the figures, head 12 provides golf club 10 with the structure of a driver. Within the scope of the present invention, however, head 12 may provide golf club 10 with the structure of another type of golf club, including an iron or a putter, for example.

Figures 1, 2A:
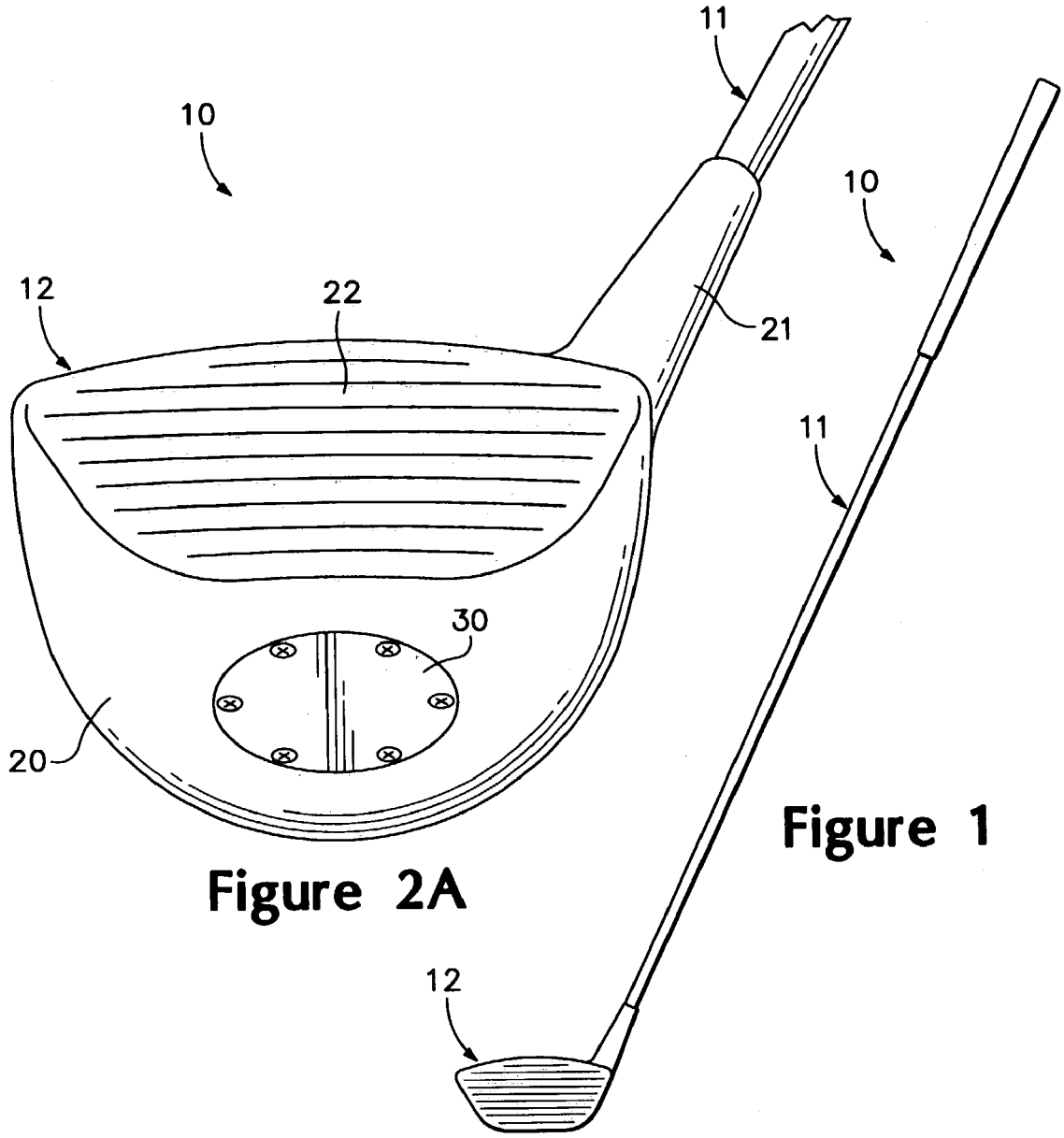
FIG. 1 is an elevational view of a first golf club having a head with a weight positioning system in accordance with the present invention.
FIG. 2A is a perspective view of the head.
Figure 2B:
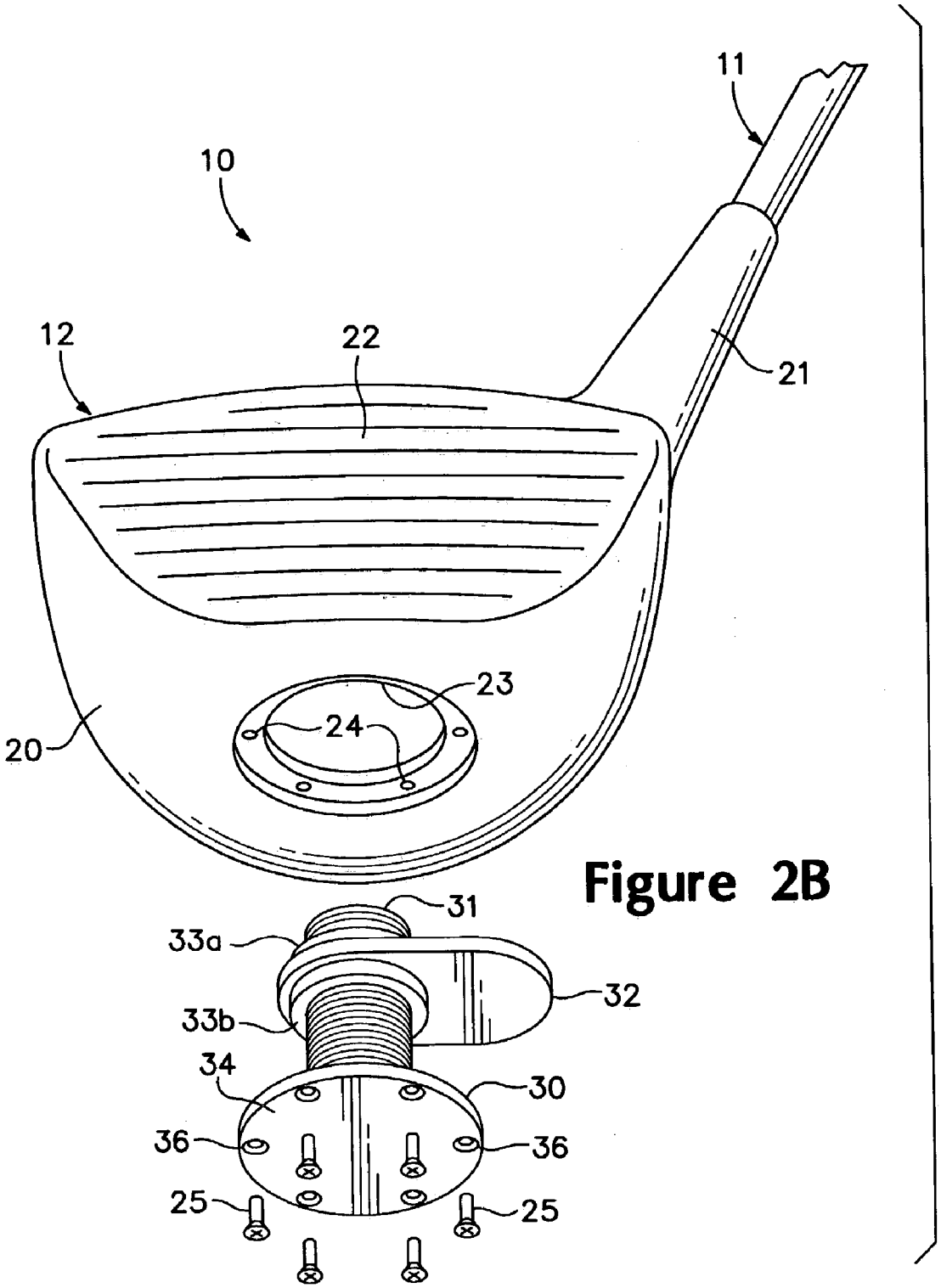
FIG. 2B is an exploded perspective view of the head.

Head 12 includes a shell 20 and a weight positioning system 30, as depicted in FIGS. 2A and 2B. Shell 20 is a partially hollow structure that defines an interior void for receiving system 30. The primary components of shell 20 are a hosel 21, a face 22, and an aperture 23. Hosel 21 is configured to couple with and securely attach to the second end of shaft 11. Face 22 is a generally planar surface that extends across shell 20 and provides a suitable area for engaging or contacting the golf ball. Aperture 23 is positioned in a lower portion of shell 20 and provides access to system 30. Suitable materials for shell 20 include any materials that are conventionally utilized for golf club heads, such as wood, steel, aluminum, or titanium.

During the game of golf, an individual grasps the first end of shaft 11 and swings golf club 10 such that head 12 traverses a generally arcuate path and impacts a golf ball. A portion of the inertia of golf club 10, and particularly the inertia of head 12, is then transferred to the golf ball and propels the golf ball toward an intended target. The position of a center of gravity of head 12 has an influence upon whether the golf ball curves right, curves left, or follows a generally straight route. More specifically, the golf ball follows a generally straight route when the center of gravity is positioned behind the point of engagement on face 22. When the center of gravity is spaced to one side of the point of engagement, however, the golf ball may follow a route that curves left or right. The position of the center of gravity of head 12 also has an influence upon whether the golf ball exhibits a boring or climbing trajectory, depending upon whether the center of gravity is spaced above or below the point of engagement on face 22.

Although the concepts behind utilizing a golf club to propel a golf ball toward an intended target appear simplistic, the actual practice of propelling the golf ball in an intended manner is exceedingly complex. The golf ball may, for example, consistently curve right when, in fact, the individual intends to propel the golf ball along a straight route. Many conventional golf club heads have a fixed center of gravity intended to accommodate a majority of the individuals that play the game of golf. Head 12, however, includes system 30, thereby permitting the individual to selectively modify the position of the center of gravity of head 12 in a manner that conforms to the particular playing style and preferences of the individual. Accordingly, the individual may utilize system 30 to correct or modify the route of the golf ball by repositioning the center of gravity of head 12 with respect to face 22.

Figure 3:
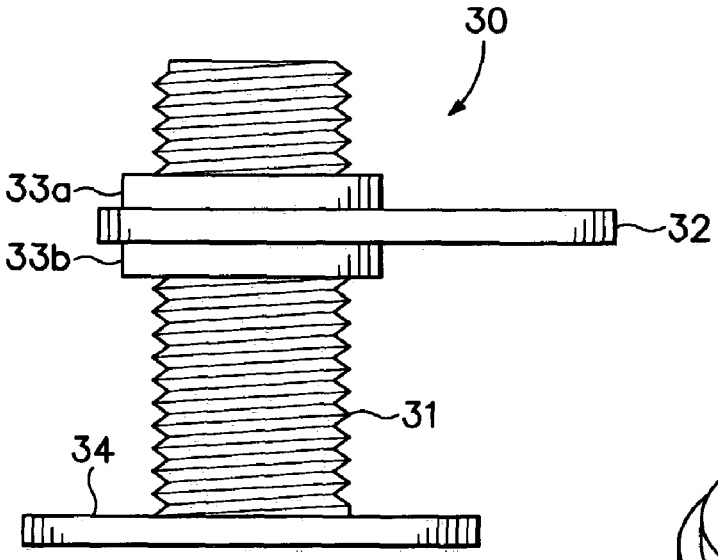
FIG. 3 is an elevational view of the weight positioning system.
Figure 4A:
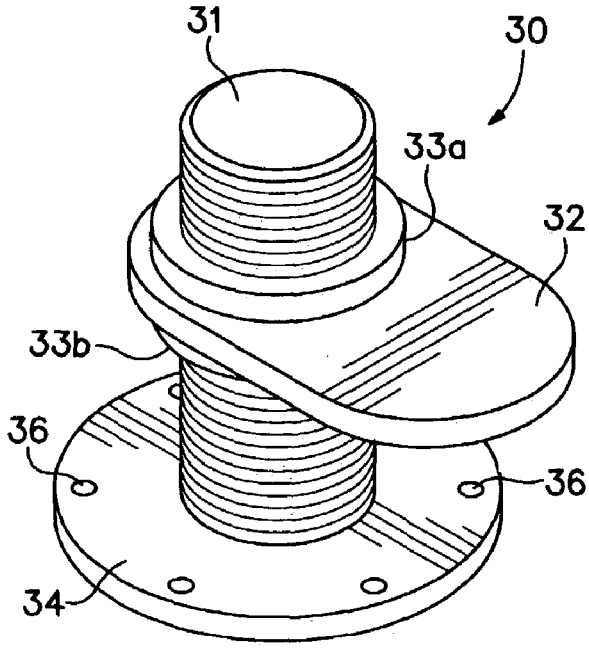
FIG. 4A is a perspective view of the weight positioning system.
Figure 4B:
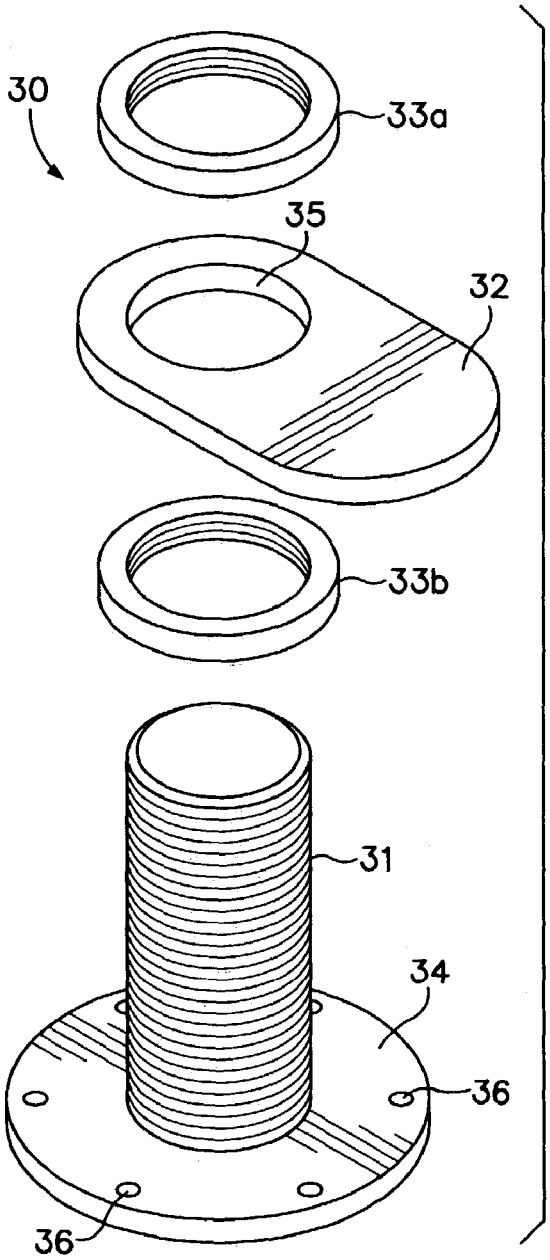
FIG. 4B is an exploded perspective view of the weight positioning system.
Figure 5:
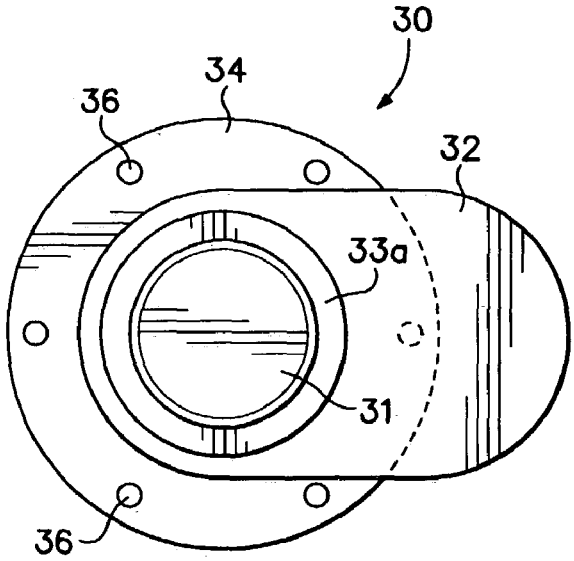
FIG. 5 is a top plan view of the weight positioning system.

System 30 is depicted individually in FIGS. 3–5 and includes a support 31, a weight 32, a pair of locking rings 33*a* and 33*b*, and a connector 34. The primary purpose of system 30 is to selectively modify the position of the center of gravity of head 12. This may be accomplished by generally moving weight 32 along support 31 and around support 31 to a desired location within shell 20. Locking rings 33*a* and 33*b* are also movable to secure weight 32 in the desired location, and connector 34 is utilized to connect system 30 to shell 20. Shell 20 receives system 30 such that support 31, weight 32, and locking rings 33*a* and 33*b* are positioned within shell 20.

The center of gravity of head 12, otherwise referred to as the center of mass, is defined as an equilibrium point. More specifically, the center of gravity of head 12 is a point at which the entire weight of head 12 may be considered as concentrated so that, if supported at that point, head 12 would remain in static equilibrium in any position. Head 12 is a combination of two elements, namely shell 20 and system 30. The position of the center of gravity of head 12 is, therefore, dependent upon the properties of shell 20 and system 30. That is, the position of the center of gravity of head 12 is influenced by the weight of shell 20, the weight of system 30, the position of the center of gravity of shell 20, and the position of the center of gravity of system 30. Accordingly, changes in any of these properties of shell 20 and system 30 effectively change the position of the center of gravity of head 12.

The weight of shell 20 and the position of the center of gravity of shell 20 are unchanging, or otherwise constant. Assume for purposes of the present discussion that the weight of system 30 is also constant. Accordingly, neither the weight of shell 20, the position of the center of gravity of shell 20, nor the weight of system 30 may act to change the position of the center of gravity of head 12. The position of the center of gravity of system 30 is, however, not constant due to changes in the position that result from moving weight 32 and locking rings 33*a* and 33*b* relative to support 31. Accordingly, moving weight 32 and locking rings 33*a* and 33*b* is an effective way to modify the position of the center of gravity of head 12. As will be discussed in greater detail below, the position of locking rings 33*a* and 33*b* is primarily dependent upon the position of weight 32. The position of the center of gravity of head 12 is, therefore, dependent upon the position of weight 32.

Support 31 has a generally elongate shape and extends through aperture 23 to provide a securely-positioned foundation for weight 32. The configuration of support 31 is selected such that weight 32 may translate along support 31 and rotate around support 31 to modify the position of the center of gravity of head 12. As depicted in the figures support 31 is oriented vertically. Accordingly, weight 32 translates in the vertical direction to modify the position of the center of gravity of head 12 in the vertical direction. Weight 32 also rotates horizontally to modify the position of the center of gravity of head 12 in the vertical direction. In alternate embodiments, support 31 may have a horizontal configuration, wherein weight 32 translates horizontally and rotates vertically to modify the position of the center of gravity of head 12 in the horizontal and vertical directions, respectively. Support 31 may also be oriented in any other manner. A benefit to the vertical and horizontal orientations, however, is that the individual will intuitively comprehend the manner in which movement of weight 32 affects the position of the center of gravity of head 12.

Support 31 is depicted as having a cylindrical configuration, and weight 32 forms a circular opening 35. The diameter of opening 35 corresponds approximately with the diameter of support 31 such that weight 32 engages and extends around support 31. In this configuration, weight 32 may translate to any longitudinal position along support 31, and weight 32 may rotate to any angular position around weight 32. In alternate embodiments, support 31 may have a hexagonal cross-section, rather than circular, and opening 35 may have a corresponding hexagonal shape. Rotation of weight 32 would, therefore, be limited to six positions. Similarly, support 31 may have a shape with a greater or lesser number of sides. Although the non-circular shapes may appear limiting in that weight 32 may not rotate to an infinite number of angular positions, such shapes may be beneficial to prevent weight 32 from inadvertently rotating.

The configuration of weight 32 is selected to induce a change in the position of the center of gravity of system 30 when weight 32 is rotated, thereby modifying the position of the center of gravity of head 12. One manner in which weight 32 may be structured to induce a change in the position of the center of gravity of system 30 is by positioning opening 35 in a spaced relationship with the position of the center of gravity of weight 32. That is, the center of gravity of weight 32 is offset from a centerline of support 31. If, for example, the center of gravity of weight 32 were positioned at a center of opening 35 and aligned with a center of support 31, then rotation of weight 32 would not affect the position of the center of gravity of weight 32. As depicted in the figures, weight 32 has a generally elongate or elliptical shape, with support 31 and opening 35 being located adjacent an end of the elongate shape. In alternate embodiments, however, weight 32 may have any practical configuration that will induce a change in the position of the center of gravity of head 12 when weight 32 is rotated about support 31. Examples of suitable shapes for weight 32 include circular, triangular, square, or any other geometrical or non-geometrical shape where the center of opening 35 and the center of gravity of weight 32 are spaced from each other.

Locking rings 33*a* and 33*b* are positioned on opposite sides of weight 32 and provide a locking mechanism for securing a position of weight 32 relative to support 31. As depicted in the figures, locking ring 33*a* is positioned above weight 32, and locking ring 33*b* is positioned below weight 32. Each of locking rings 33*a* and 33*b* are threaded to correspond with threads formed in support 31. Accordingly, locking rings 33*a* and 33*b* may be rotated to securely engage opposite sides of weight 32. Locking rings 33*a* and 33*b* may also be rotated in an opposite direction to disengage weight 32 and permit weight 32 to move relative to support 31. Locking rings 33*a* and 33*b* provide one example of a locking mechanism that may be utilized to secure the position of weight 32 relative to support 31. Within the scope of the present invention, however, a variety of other locking mechanisms may be utilized.

Connector 34 is positioned on an end of support 31 and may be formed integral with support 31, or may be separately formed and subsequently joined with support 31. As depicted in the figures, connector 34 is a generally circular and planar structure that joins system 30 to shell 20. Connector 34 includes a plurality of bores 36 that correspond with a plurality of bores 24 extending around aperture 23. In order to secure system 30 to shell 20, bores 36 are aligned with bores 24 and a plurality of fasteners 25, such as screws, are positioned therethrough. Within the scope of the present invention, however, connector 34 may have any configuration that joins system 30 to shell 20.

Suitable materials for system 30 include polymers, metals, ceramics, or composite materials, for example. For a given change in position of weight 32, the effect upon the position of the center of gravity of head 12 depends upon the relative weights of head 12 and weight 32. If, for example, weight 32 has a relatively small mass, then the change in position of the center of gravity of head 12 will be relatively small. Similarly, a weight 32 with a relatively large mass will have a relatively large effect upon the change in position of the center of gravity of head 12. Accordingly, weight 32 may be formed from a variety of materials, such as polymers or various metals, to impart the desired amount of change in position of the center of gravity of head 12. Examples of suitable materials for support 31 include metals such as aluminum or titanium. Examples of suitable materials for weight 32 include, therefore, high-density materials such as steel, tungsten, or bismuth, or composite materials with a high-density material concentrated away from support 31.

Weight 32 is not the only movable component of system 30. Locking rings 33*a* and 33*b* also move with weight 32. Accordingly, locking rings 33*a* and 33*b* also affect the position of the center of gravity of head 12. In order to minimize the effects of locking rings 33*a* and 33*b*, the material selected for locking rings 33*a* and 33*b* may be significantly lighter than the material selected for weight 32. For example, weight 32 may be formed from steel or another metal, whereas locking rings 33*a* and 33*b* may be formed from a polymer.

The manner in which system 30 is utilized to modify the position of the center of gravity of head 12 will now be discussed with reference to FIGS. 6A–6D. For purposes of reference in FIGS. 6A–6D, a double-headed arrow 41 is utilized to illustrate the vertical direction, another double-headed arrow 42 is utilized to illustrate the horizontal direction.

Figure 6A:
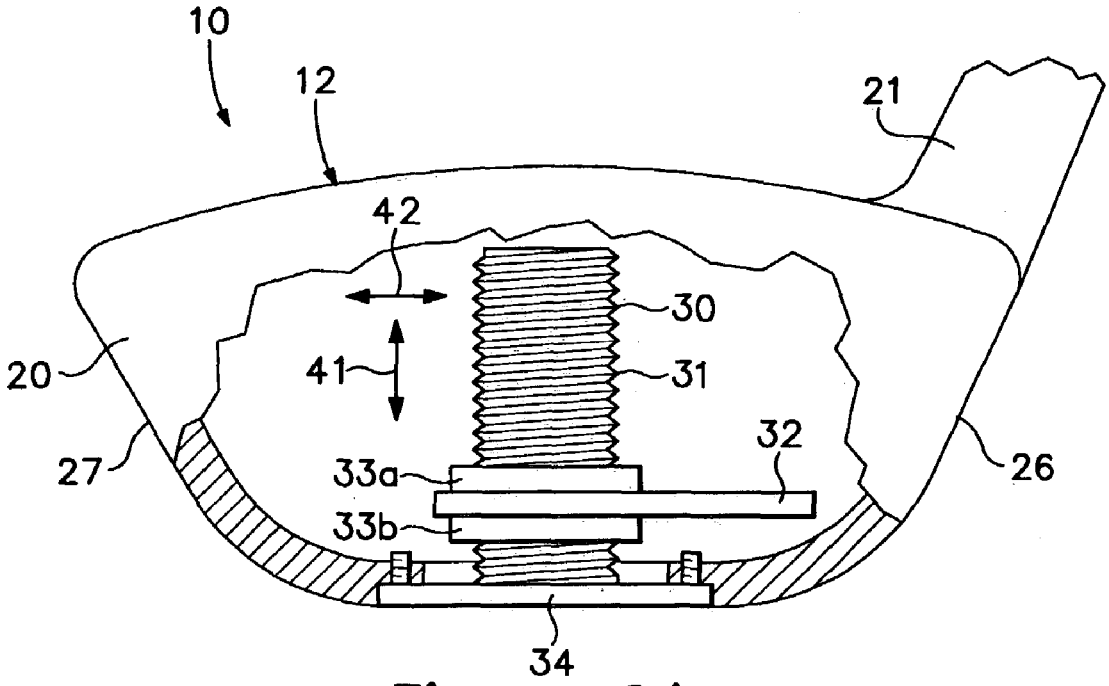
FIG. 6A is a cut-away elevational view of the head that depicts a weight in a first position.
Figure 6B:
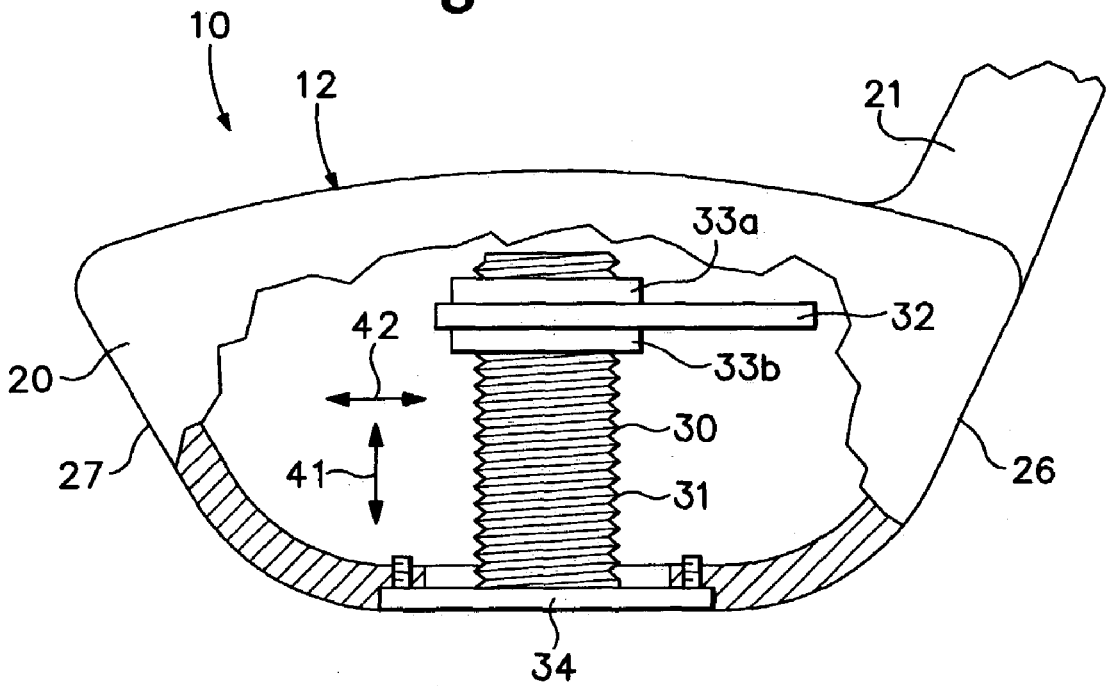
FIG. 6B is a cut-away elevational view of the head that depicts the weight in a second position.

With reference to FIG. 6A, weight 32 is depicted as being located toward a lower portion of support 31 and on a side of support 31 that faces a heel side 26 of shell 20. Following the use of golf club 10, the individual may determine that moving the center of gravity of head 12 in the vertical direction would be beneficial. To accomplish this, system 30 may be removed from shell 20 and locking rings 33*a* and 33*b* may be moved out of contact with weight 32. Weight 32 may then be moved upward to a different position, and locking rings 33*a* and 33*b* may again be placed in contact with opposite sides of weight 32. System 30 is then replaced within shell 20, as depicted in FIG. 6B.

Moving weight 32 upward in the vertical direction has the effect of also moving the center of gravity of head 12 upward in the vertical direction. Whereas weight 32 moved a significant distance along support 31, the center of gravity of head 12 moved a comparatively minor amount. The rationale behind the comparatively small movement of the center of gravity of head 12 is that weight 32 has an appreciable but small effect upon the position of the center of gravity of head 12. As discussed above, the position of the center of gravity of head 12 is influenced by the weight of shell 20, the weight of system 30, the position of the center of gravity of shell 20, and the position of the center of gravity of system 30. The position of weight 32 is only one of many factors, therefore, that have an effect upon the position of the center of gravity of head 12.

Moving the center of gravity of head 12 upward in the vertical direction alters the position of the center of gravity with respect to face 22. As discussed above, the position of the center of gravity of head 12 also has an influence upon whether the golf ball exhibits an arcing or a low, flat trajectory, depending upon whether the center of gravity is spaced above or below the point of engagement on face 22. Accordingly, moving weight 32 in the vertical direction with respect to face 22 may be utilized to change the trajectory of the ball.

Figure 6C:
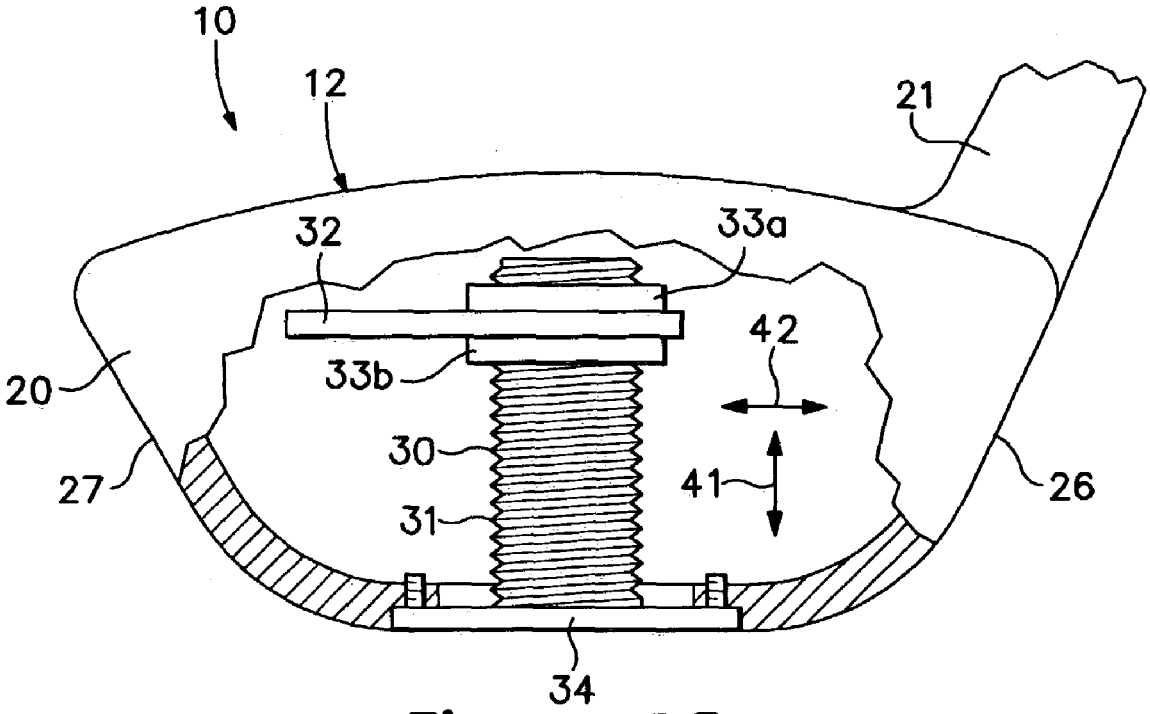
FIG. 6C is a cut-away elevational view of the head that depicts the weight in a third position.

Following continued use of golf club 10, the individual may determine that moving the center of gravity of head 12 in the horizontal direction would be beneficial. As with the prior adjustment, system 30 may be removed from shell 20 and locking rings 33*a* and 33*b* may be moved out of contact with weight 32. Weight 32 may then be moved around to a side of support 31 that faces a toe side 27 of shell 20, and locking rings 33*a* and 33*b* may again be placed in contact with opposite sides of weight 32. System 30 is then replaced within shell 20, as depicted in FIG. 6C.

Moving weight 32 in the horizontal direction had the effect of also moving the center of gravity of head 12 in the horizontal direction. As with the vertical movement, the center of gravity of head 12 moved a relatively minor amount in the horizontal direction when compared to the overall movement of weight 32. One benefit of system 30 is that weight 32 is independently movable in the vertical direction and independently movable in the horizontal direction to vary a position of the center of gravity of head 12. The adjustment occurring between FIGS. 6A and 6B moved the center of gravity of head 12 in only the vertical direction. Similarly, the adjustment occurring between FIGS. 6B and 6C moved the center of gravity of head 12 in only the horizontal direction. By providing the individual with independent adjustability in the vertical and horizontal directions, greater control over the specific effect upon the route of the golf ball is achieved.

Moving the center of gravity of head 12 upward in the horizontal direction also alters the position of the center of gravity with respect to face 22. As discussed above, the position of a center of gravity of head 12 has an influence upon whether the golf ball curves right, curves left, or follows a generally straight route, depending upon whether the center of gravity is spaced right or left of the point of engagement on face 22. Accordingly, moving weight 32 in the horizontal direction with respect to face 22 may be utilized to change the trajectory of the ball.

Figure 6D:
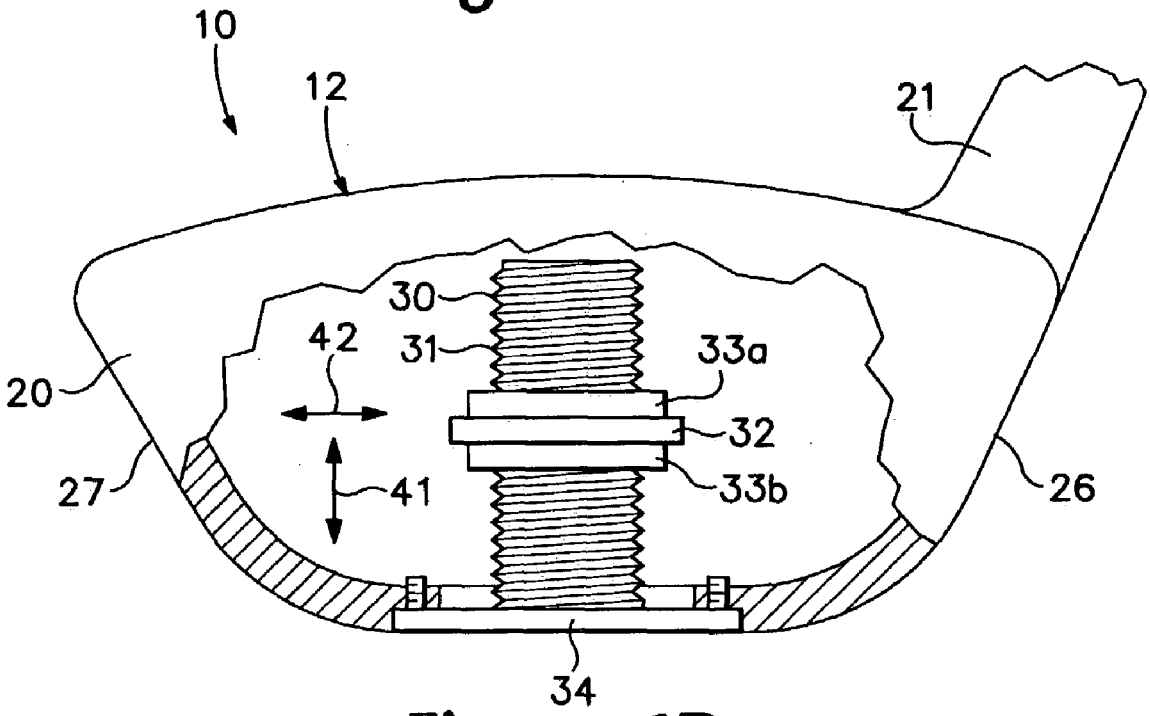
FIG. 6D is a cut-away elevational view of the head that depicts the weight in a fourth position.

Although independent adjustability is beneficial, circumstances may arise wherein a repositioning of the center of gravity of head 12 in both the vertical and horizontal directions is required. As with the prior adjustments, system 30 may be removed from shell 20 and locking rings 33*a* and 33*b* may be moved out of contact with weight 32. Weight 32 may then be moved downward and to an area that is generally centered between heel side 26 and toe side 27, and locking rings 33*a* and 33*b* may again be placed in contact with opposite sides of weight 32. System 30 is then replaced within shell 20, as depicted in FIG. 6D. Moving weight 32 in the vertical and horizontal directions has the effect of also moving the center of gravity of head 12 in the vertical and horizontal directions with respect to face 22.

Based upon the discussion above, the center of gravity of head 12 may be repositioned solely in the vertical direction, repositioned solely in the horizontal direction, or repositioned simultaneously in both the vertical and horizontal directions with respect to face 22. In order to provide this variability, weight 32 moves along support 31 and around support 31. Weight 32 is, therefore, movable in three dimensions with respect to support 31 to vary a position of the center of gravity of head 12 with respect to face 22. An advantage of system 30 in this regard is that this variability with respect to the repositioning of the center of gravity of head 12 is achieved with a single support 31 and weight 32.

Figure 7:
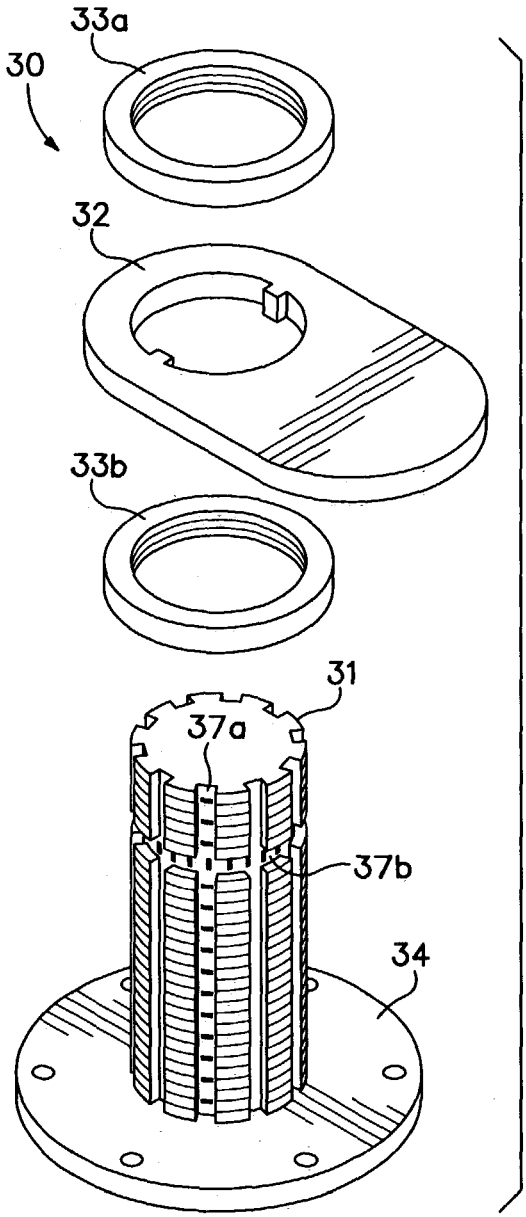
FIG. 7 is an exploded perspective view of another configuration of the weight positioning system.

The specific configuration of system 30 disclosed above may be modified in many respects within the scope of the present invention. For example, a series of indentations may be formed in the exterior surface of support 31, and corresponding protrusions may be formed in opening 35, as depicted in FIG. 7. The indentations and protrusions may be utilized to limit the rotational positioning of weight 32 to defined locations around support 31. Scales 37*a* and 37*b* may also be placed upon the exterior surface of support 31 to provide a frame of reference regarding the position of weight 32.

Figure 8A:
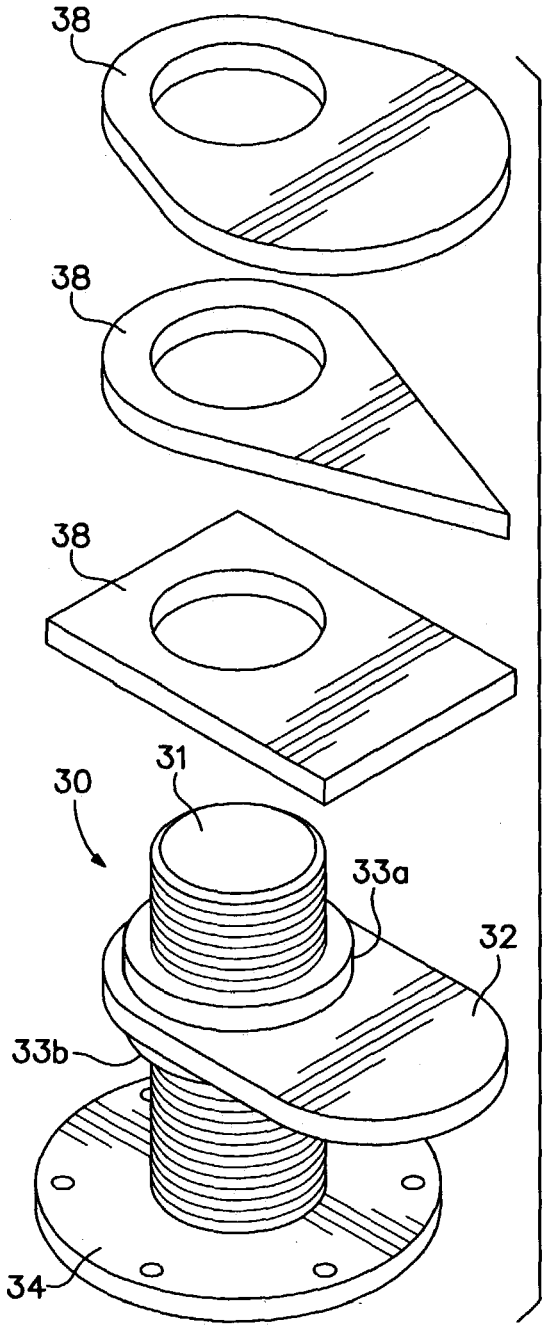
FIG. 8A is a perspective view of various configurations of the weight positioning system.
Figure 8B:
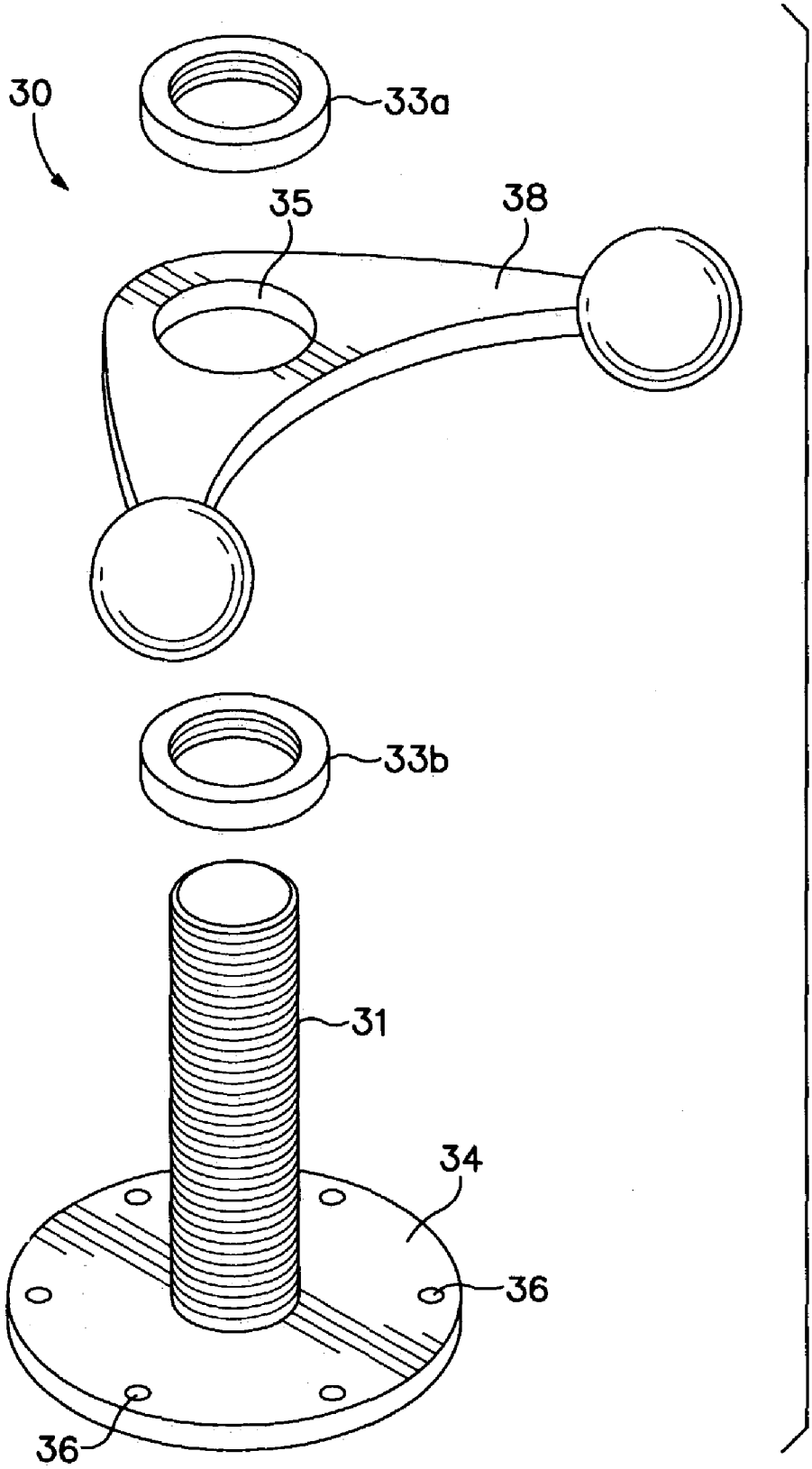
FIG. 8B is an exploded perspective view of yet another configuration of the weight positioning system.

In the above discussion the overall mass of system 30, and particularly the mass of weight 32, was a constant. In another embodiment of the present invention, which is depicted in FIG. 8A, weight 32 may be replaced by alternate weights 38 that each have a different shape or a different mass, for example. Replacing weight 32 with an alternate weight 38 may be utilized to increase or decrease the degree to which the center of gravity of head 12 is repositioned. The various weights 38 may have various configurations from generally rectangular to triangular or ovoid, for example. As an alternative to the various structures of weight 32 and weights 38 that are disclosed in FIG. 8A, system 30 may have a weight 38 having the configuration depicted in FIG. 8B. This weight 38 has a pair of arms that extend outward from opening 35 and a pair of masses secured to ends of the arms. As depicted, the arms are angled with respect to each other, but may extend outward in opposite directions. Accordingly, the specific configuration of weight 32 or weights 38 may vary significantly within the scope of the present invention.

Figure 9A:
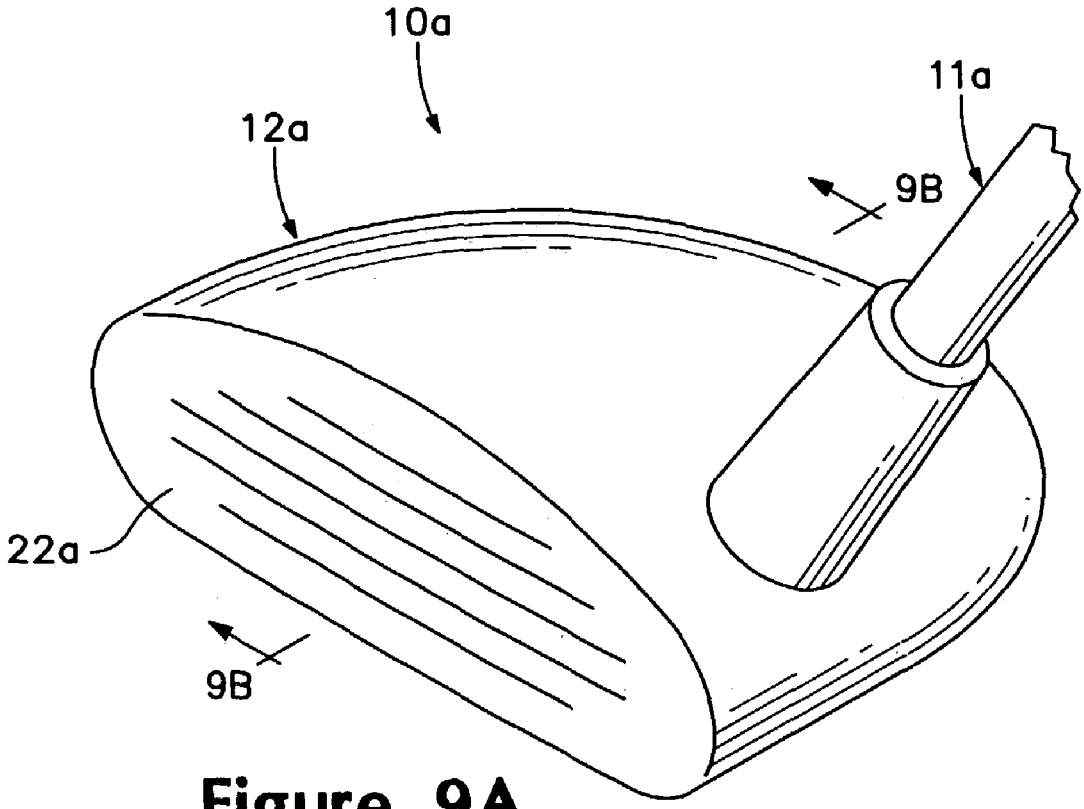
FIG. 9A is a partial perspective view of a second golf club having a head that incorporates the weight positioning system.
Figure 9B:
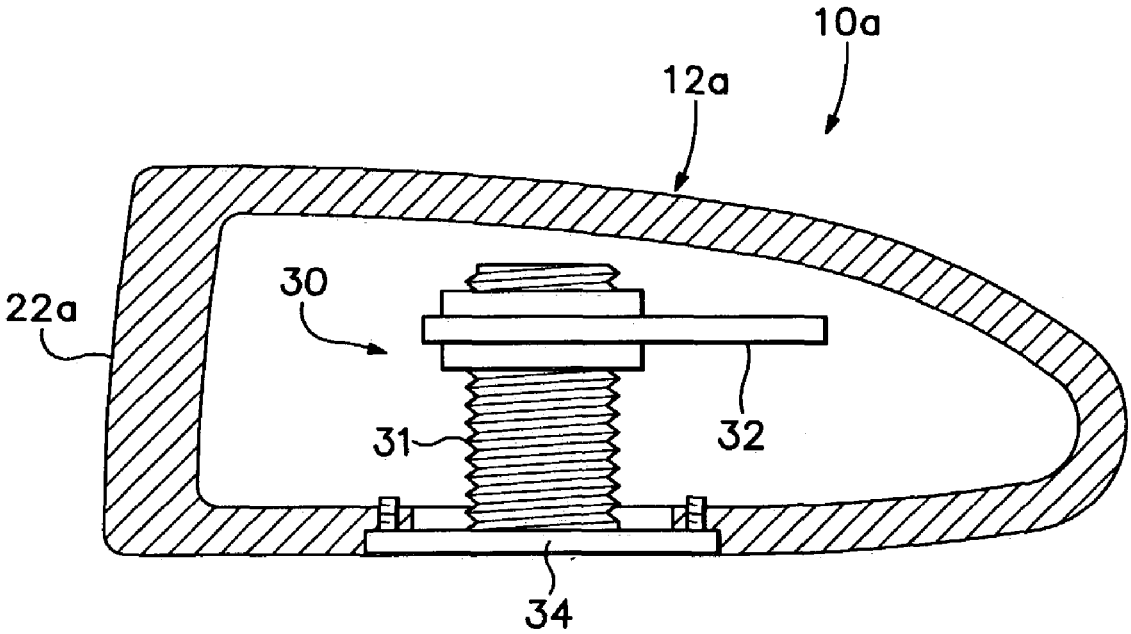
FIG. 9B is a cross-sectional view of a head of the second golf club, as defined by line 9B—9B in FIG. 9A.

Golf club 10 is depicted and discussed above as a driver. Other types of golf clubs may also incorporate weight positioning system 30. With reference to FIGS. 9A and 9B, a golf club 10*a* having the general configuration of a putter is disclosed. Golf club 10*a* includes a shaft 11*a* and a head 12*a*, with weight positioning system 30 being located on an interior portion of head 12*a*. In a manner that is substantially similar to the process discussed above with respect to golf club 10, system 30 may be utilized to alter a position of a center of gravity of head 12*a*, thereby moving the center of gravity with respect to a face 22*a* of head 12*a*. Accordingly, the position of the center of gravity of head 12*a* may be modified by the individual to meet the unique requirements or playing style of the individual.

Figure 10:
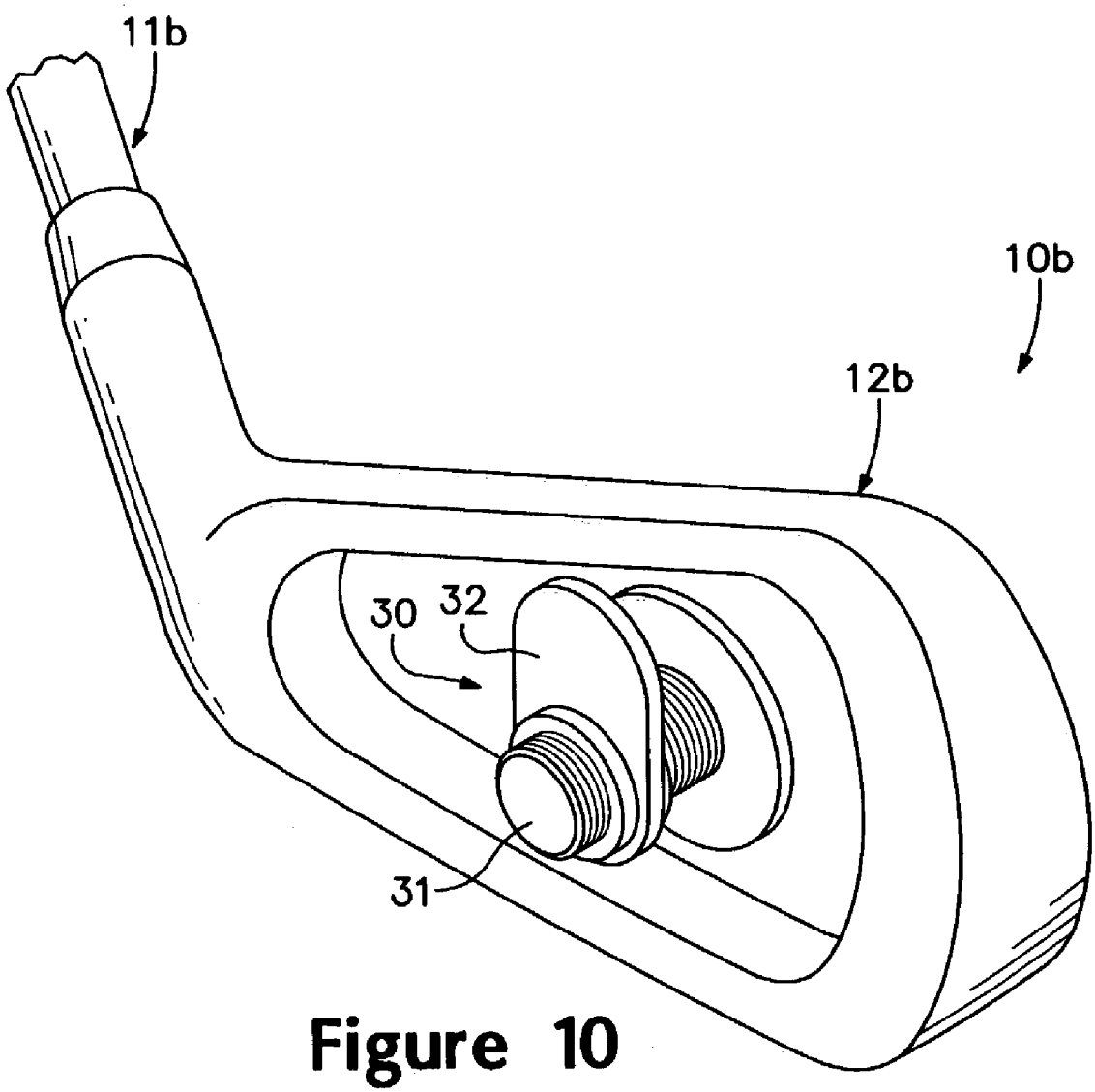
FIG. 10 is a partial perspective view of a third golf club having a head that incorporates the weight positioning system.

A golf club 10*b* having the general configuration of an iron is disclosed in FIG. 10. Golf club 10*b* includes a shaft 11*b* and a head 12*b*. In contrast with golf club 10 and golf club 10*b*, weight positioning system 30 is located on an exterior portion of head 12*b*, rather than on an interior portion. System 30 is, therefore, exposed and more accessible to the individual, thereby facilitating changes in the position of a center of gravity of head 12*b*. A further difference between golf club 10*b* and golf clubs 10 and 10*a* relates to the orientation of system 30. In both of golf clubs 10 and 10*a*, support 31 is secured is a substantially vertical orientation. In golf club 10*b*, however, support 31 is secured is a substantially horizontal orientation and extends rearward from a back of head 12*b*. In some embodiments, support 31 may be oriented perpendicularly with respect to a face of head 12*b*.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. A golf club head having a face for contacting a golf ball and a weight positioning system, the weight positioning system comprising:

a support having a longitudinal axis extending along a length of the support; and a weight that is movable along the support and around the support to vary a position of a center of gravity of the golf club head, the weight defining an opening that extends at least partially around the support, wherein one of an indentation and a protrusion extends along the support and in a direction substantially parallel to the longitudinal axis of the support, and another of the indentation and the protrusion is positioned within the opening, the indentation receiving the protrusion to limit movement of the weight around the support.

2. The golf club head recited in claim 1, wherein a center of gravity of the weight is offset from the opening.

3. The golf club head recited in claim 1, wherein the golf club head includes a shell that defines the face.

4. The golf club head recited in claim 3, wherein the weight positioning system is located within the shell.

5. The golf club head recited in claim 3, wherein the shell defines an aperture and the weight positioning system is removable from an interior of the shell through the aperture.

6. The golf club head recited in claim 5, wherein the aperture is positioned in a lower area of the shell.

7. The golf club head recited in claim 1, wherein the longitudinal axis of the support is oriented substantially parallel to the face.

8. The golf club head recited in claim 1, wherein the weight positioning system includes a locking mechanism that secures a position of the weight relative to the support.

9. The golf club head recited in claim 8, wherein the locking mechanism is a pair of locking rings that extend around the support and are positioned on opposite sides of the weight.

10. The golf club head recited in claim 1, wherein the weight has an elliptical shape.

11. The golf club head recited in claim 1, wherein the weight positioning system includes at least one scale to determine a position of the weight relative to the support.

12. The golf club head recited in claim 11, wherein the scale is positioned on a surface of the support.

13. The golf club head recited in claim 11, wherein the at least one scale includes a first scale and a second scale, the first scale being oriented to extend in a direction substantially parallel to the longitudinal axis to determine a position of the weight along the support, and the second scale being oriented to extend in a direction substantially perpendicular to the longitudinal axis to determine a position of the weight around the support.

14. The golf club head recited in claim 1, wherein the weight is interchangeable with one of a plurality of alternate weights.

15. The golf club head recited in claim 14, wherein at least one of the alternate weights has a different mass than the weight.

16. The golf club head recited in claim 14, wherein at least one of the alternate weights has a different shape than the weight.

17. The golf club head recited in claim 1, wherein the weight positioning system is mounted on an exterior of the golf club head.

18. The golf club head recited in claim 1, wherein the weight includes a pair of arms that extend outward from the support, and a pair of masses are secured to the arms.

19. The golf club head recited in claim 18, wherein the arms are angled with respect to each other.

20. A golf club head having a face for contacting a golf ball and a weight positioning system, the weight positioning system comprising:

a support having a longitudinal axis extending along a length of the support;

a weight that is movable along the support and around the support to vary a position of a center of gravity of the golf club head, the weight defining an opening that extends at least partially around the support; and at least one scale located to determine a position of the weight relative to the support, the at least one scale including a first scale and a second scale, the first scale being oriented to extend in a direction substantially parallel to the longitudinal axis, and the second scale being oriented to extend in a direction substantially perpendicular to the longitudinal axis.

21. The golf club head recited in claim 20, wherein the scale is positioned on a surface of the support.

22. The golf club head recited in claim 20, wherein the first scale determines a position of the weight along the support, and the second scale determines a position of the weight around the support.

23. The golf club head recited in claim 20, wherein an indentation extends along the support and in a direction parallel to the longitudinal axis of the support, and a protrusion is positioned within the opening, the indentation receiving the protrusion to limit movement of the weight around the support.

24. The golf club head recited in claim 23, wherein the scale is positioned within the indentation.

25. The golf club head recited in claim 23, wherein a center of gravity of the weight is offset from the opening.

26. The golf club head recited in claim 23, wherein the golf club head includes a shell that defines the face.

27. The golf club head recited in claim 26, wherein the weight positioning system is located within the shell.

28. The golf club head recited in claim 20, wherein the longitudinal axis of the support is oriented substantially parallel to the face.

29. The golf club head recited in claim 20, wherein the weight has an elliptical shape.

30. The golf club head recited in claim 20, wherein a center of gravity of the weight is offset from the opening.

31. The golf club head recited in claim 20, wherein the weight is interchangeable with one of a plurality of alternate weights.

32. The golf club head recited in claim 31, wherein at least one of the alternate weights has a different mass than the weight.

33. The golf club head recited in claim 31, wherein at least one of the alternate weights has a different shape than the weight.

34. The golf club head recited in claim 20, wherein the weight positioning system is mounted on an exterior of the golf club head.

35. The golf club head recited in claim 20, wherein the weight includes a pair of arms that extend outward from the support, and a pair of masses are secured to the arms.

36. The golf club head recited in claim 35, wherein the arms are angled with respect to each other.

37. A golf club head having a face for contacting a golf ball and a weight positioning system, the weight positioning system comprising:

a support having a longitudinal axis extending along a length of the support;

a weight that is movable along the support and around the support to vary a position of a center of gravity of the golf club head, the weight defining an opening that extends at least partially around the support; and at least one scale located to determine a position of the weight relative to the support, wherein an indentation extends along the support and in a direction parallel to the longitudinal axis of the support, and a protrusion is positioned within the opening, the indentation receiving the protrusion to limit movement of the weight around the support.

38. The golf club head recited in claim 37, wherein the scale is positioned on a surface of the support.

39. The golf club head recited in claim 37, wherein the scale is positioned within the indentation.

40. The golf club head recited in claim 37, wherein a center of gravity of the weight is offset from the opening.

41. The golf club head recited in claim 37, wherein the golf club head includes a shell that defines the face.

42. The golf club head recited in claim 37, wherein the weight positioning system as located within the shell.

43. The golf club head recited in claim 37, wherein the longitudinal axis of the support is oriented substantially parallel to the face.

44. A golf club head having a face for contacting a golf ball and a weight positioning system, the weight positioning system comprising:

a support having a longitudinal axis extending along a length of the support;

a weight with an elliptical shape, the weight being movable along the support and around the support to vary a position of a center of gravity of the golf club head, the weight defining an opening that extends at least partially around the support; and at least one scale located to determine a position of the weight relative to the support.

45. The golf club head recited in claim 44, wherein the scale is positioned on a surface of the support.

46. The golf club head recited in claim 44, wherein a center of gravity of the weight is offset from the opening.

47. The golf club head recited in claim 44, wherein the weight is interchangeable with one of a plurality of alternate weights.

48. The golf club head recited in claim 47, wherein at least one of the alternate weights has a different mass than the weight.

49. The golf club head recited in claim 47, wherein at least one of the alternate weights has a different shape than the weight.

50. The golf club head recited in claim 44, wherein the weight positioning system is mounted on an exterior of the golf club head.

* * * * *